United States Patent [19]

Schutte

[11] 3,941,118

[45] Mar. 2, 1976

[54] HOT WATER SUPPLY SYSTEM

[75] Inventor: Hendrik Schutte, Kampen, Netherlands

[73] Assignee: Air-O-Mulder B.V., Netherlands

[22] Filed: Apr. 30, 1975

[21] Appl. No.: 573,086

[30] Foreign Application Priority Data

May 10, 1974 Netherlands ..... 7406357

[52] U.S. Cl. ..... 126/362; 126/387; 126/350 R

[51] Int. Cl.[2] ..... F24H 1/00

[58] Field of Search ..... 126/361, 362, 373, 350 R, 126/351, 350 D, 387; 122/17; 238/20

[56] References Cited

UNITED STATES PATENTS

| | | | |
|---|---|---|---|
| 523,738 | 7/1894 | Duncan | 126/362 |
| 2,278,619 | 4/1942 | Leo | 126/387 |
| 2,440,998 | 5/1948 | Alexander | 126/351 |
| 2,814,279 | 11/1957 | Thomas | 126/362 |

*Primary Examiner*—Kenneth W. Sprague
*Assistant Examiner*—Larry I. Schwartz
*Attorney, Agent, or Firm*—Wilkinson, Mawhinney & Theibault

[57] ABSTRACT

A gas-heated hot water reservoir comprising a supply connection for fresh water and a discharge connection to an insulated distribution line for hot water leading towards a plurality of taps, said reservoir further comprising a gasburner and a pilot burner, the latter being positioned under a vertical passage through the reservoir with an annular space around it, bounded by an insulating wall secured to the bottom of the reservoir, an open-ended thin pipe accomodated within the distribution line between the annular space and a zone near the farthest tap.

1 Claim, 2 Drawing Figures

HOT WATER SUPPLY SYSTEM

BACKGROUND OF THE INVENTION

My invention relates to a hot water supply system comprising a gas-heated hot water reservoir consisting of a vessel with a connection for the supply of cold water and with an insulated distribution line for hot water to be fed to a plurality of taps. Such a system is known in various versions and is often used in houses and the like.

A loss of heat always occurs; this is substantially caused by the distribution line and consists of a direct loss, owing to heat transfer to the surroundings. A second loss of no less importance is that of water, which loss periodically happens when from a certain tap warm water is desired and one has to leave the tap running for removing the cooled off water first. The disadvantage of the cooled off distribution line will particularly be encountered for those taps which are far from the reservoir and where only small or intermittent quantities of warm water are tapped, like wash bassins in bedrooms and kitchen taps which are mostly farthest from the reservoir in the upper store of the house.

DISCUSSION OF THE PRIOR ART

One has tried to compensate for the first mentioned losses in the best possible way by insulating the distribution line, but a certain cooling cannot be avoided. For the losses mentioned in the second place no acceptable remedy has been found so far. It has been formerly suggested to have the water circulate in the distribution line by means of an electric circulating pump in order to compensate for thermal losses. This implies: installation costs, maintenance and energy consumption.

SURVEY OF THE DRAWINGS

DESCRIPTION OF A PREFERRED EMBODIMENT

Figures 1, 2:
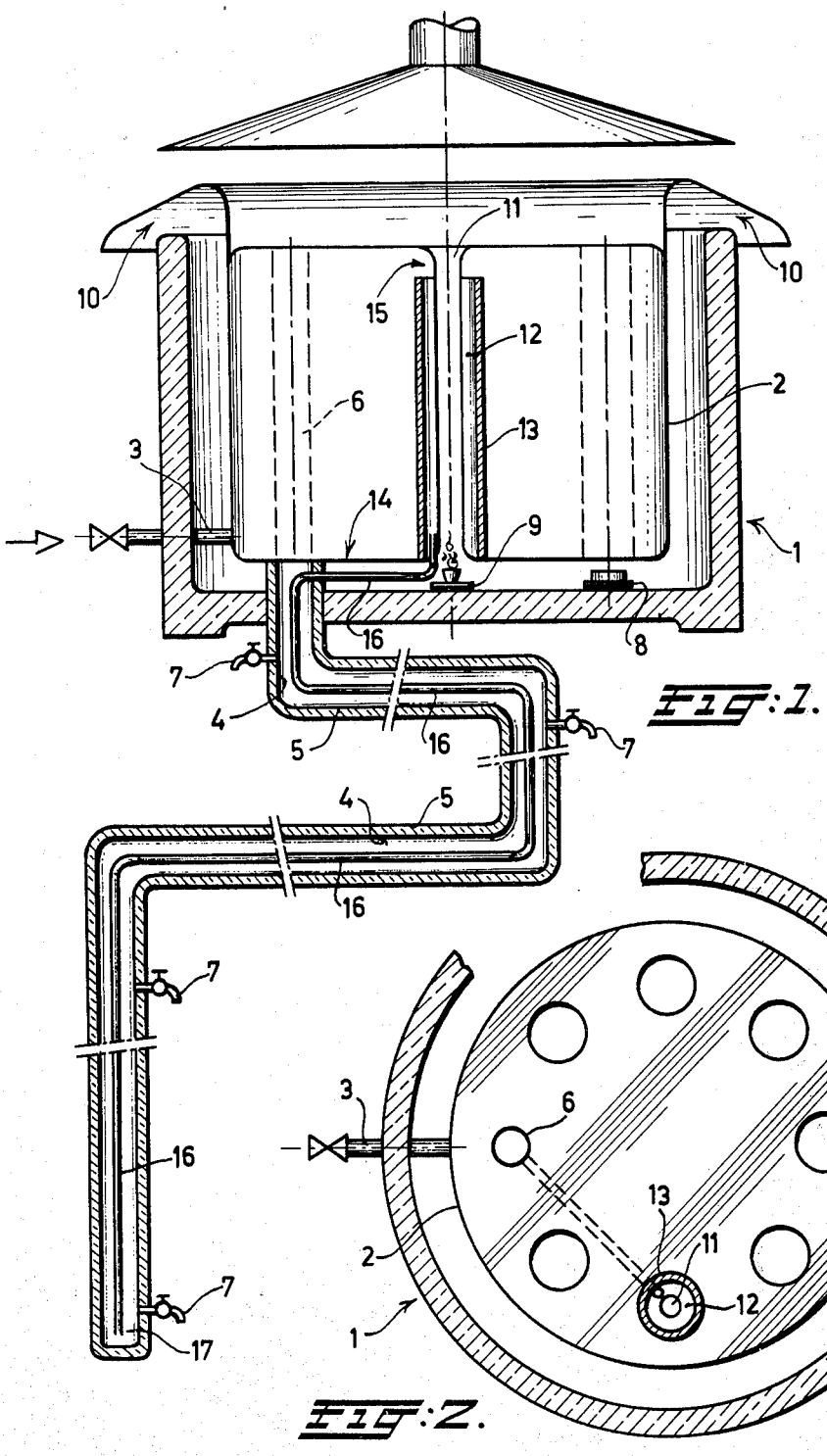
FIG. 1 shows a vertical section through a gas-heated hot water reservoir with a few parts of an insulated distribution line.
FIG. 2 is a section according to line II—II in FIG. 1.

The system as shown in FIG. 1 consists of a gas-heated hot water reservoir 1 in conformity to Netherlands Pat. application No. 74.04175 comprising a vessel 2 with a connection 3 for the supply of cold water. A distribution line 4 with an insulation 5 is connected to the vessel via a stand pipe 6. Only some parts of the distribution line 4 with taps 7 connected thereto are shown. A gas burner 8 is mounted underneath vessel 2, which in FIG. 1 is only partially represented. This burner 8 constitutes the principal burner for heating the contents of reservoir 2. In the usual manner a pilot burner 9 is arranged serving to safeguard the operation and for ignition of the principal burner 8. The combustion air is supplied via a feed zone 10 in the proximity of the upper end of the reservoir 1. So far, the device corresponds substantially to the device according to the aforementioned prior Patent Application.

The pilot burner 9 is positioned underneath a vertical channel 11 extending through vessel 2. In this vessel 2 and around said channel 11 an insulating jacket 13 is arranged in spaced relationship from said channel. This jacket bears sealingly on the bottom 14 of the vessel, but leaves at its upper end a passage 15 in open communication with the remaining portions of the vessel. A thin circulation pipe 16 is mounted within its distribution line 4. This pipe opens at its upper end into the intermediate space 12 and its communication with this space is therefore unhampered. The other open end 17 of the pipe 16 is lying in the vicinity of the farthest tap 7.

The effect of the system according to my invention is as follows:

Due to channel 11 over pilot burner 9, the water in space 12 is heated up to 100° C, contrary to the other contents of the vessel 2 with a temperature not exceeding a value of 80° C. This means that the water in the intermediate space 12 has less weight and causes a pressure difference within the height of column 12 of about 12,5 mm watercolumn/m height. Water with a temperature of 100° C will therefore rise in the intermediate space 12 and consequently such water in circulation pipe 16 and causing it to move. This results into a suction of water from the distribution line 4 to the open end 17 of pipe 16. As a consequence a slow flow will occur, beginning at stand pipe 6 and passing through distribution line 4, circulation pipe 16 and the intermediate space 12. The flow being very slow, an almost identical water temperature will prevail at any level within circulation pipe 16 and distribution line 4. Difference of weight in water, if any, in distribution line 4 and circulation pipe 16 are therefore cancelled at any level, causing negative circulation forces to get nearly neutralized.

The system according to my invention can be considered as a thermal-circulation pump in which only resistance of water flowing through the distribution line and the circulation pipe need be overcome. An important secondary advantage of the invention is that on tapping water at one of the taps 7 the circulation pipe 16 operates also as a feeder while hot water (100° C) will stimulate a fast heating of the hot water distribution line, due to heat exchange.

What is claimed is:

1. A hot water supply system comprising a gas-heated hot water reservoir consisting of a vessel with a connection for the supply of cold water and with an insulated distribution line for hot water, a plurality of taps spaced along the distribution line, a vertical channel extending through the vessel, further provided with at least one gas burner with a pilot burner, the latter burner being placed underneath said vertical channel, an insulating jacket being mounted in the vessel around the channel in spaced relationship therefrom, and forming an annular space therebetween this jacket bearing sealingly on the bottom of the vessel, but at the upper end leaving a passage leading to the remaining portions of the vessel, a thin circulation pipe being arranged within the distribution line, which pipe at its one end opens into the annular space whilst the other open end is situated near the farthest tap.

* * * * *